US007876299B2

(12) United States Patent
Bolotski

(10) Patent No.: US 7,876,299 B2
(45) Date of Patent: Jan. 25, 2011

(54) METHODS AND SYSTEMS OF PIXEL ILLUMINATION

(75) Inventor: Michael Bolotski, Seattle, WA (US)

(73) Assignee: High Definition Integration Ltd., Grand Cayman (KY)

( * ) Notice: Subject to any disclaimer, the term of this patent is extended or adjusted under 35 U.S.C. 154(b) by 991 days.

(21) Appl. No.: 11/704,236

(22) Filed: Feb. 9, 2007

(65) Prior Publication Data

US 2007/0188524 A1 Aug. 16, 2007

Related U.S. Application Data

(60) Provisional application No. 60/772,525, filed on Feb. 13, 2006.

(51) Int. Cl.
*G09G 3/36* (2006.01)

(52) U.S. Cl. ..... 345/87; 345/92; 345/690

(58) Field of Classification Search ..... 345/38, 345/42, 48, 50–53, 83–84, 87–90, 92, 94–97, 345/100, 208–214, 690
See application file for complete search history.

(56) References Cited

U.S. PATENT DOCUMENTS

| | | | | |
|---|---|---|---|---|
| 6,144,353 | A * | 11/2000 | McKnight | 345/94 |
| 6,738,107 | B2 * | 5/2004 | Nagase et al. | 349/39 |
| 7,106,285 | B2 * | 9/2006 | Naugler | 345/87 |
| 7,417,611 | B2 * | 8/2008 | Koma | 345/88 |
| 7,515,129 | B2 * | 4/2009 | Jeoung et al. | 345/87 |

* cited by examiner

*Primary Examiner*—Henry N Tran
*Assistant Examiner*—Mansour M Said
(74) *Attorney, Agent, or Firm*—Sterne, Kessler, Goldstein & Fox P.L.L.C.

(57) ABSTRACT

A method of illuminating a pixel on a display to a desired brightness level that includes dividing a time required to reach a maximum brightness level into one or more time slices, varying a pixel voltage associated with the pixel according to a sequence of voltage values over the one or more time slices, and gradually increasing the brightness of the pixel according to the pixel voltage.

11 Claims, 5 Drawing Sheets

METHODS AND SYSTEMS OF PIXEL ILLUMINATION

CROSS-REFERENCE TO RELATED APPLICATIONS

The present application claims the benefit of U.S. Provisional Patent Application No. 60/772,525 filed on Feb. 13, 2006, which is incorporated herein by reference.

FIELD OF THE INVENTION

The present invention relates generally to display systems. More particularly, the invention relates to a method and system for illuminating a display.

BACKGROUND OF THE INVENTION

Technology using liquid crystals for displays is increasingly common in today's electronic applications. Liquid Crystal Display (LCD) and Liquid Crystal on Silicon (LCOS) are examples of such technology.

In many liquid crystal applications, a display needs to be illuminated instantaneously and for short periods of time. Liquid crystal pixels, however, are characterized by a response time representative of the time required for pixels to transition from being completely dark to a certain brightness level. Accordingly, pixels may not be provided sufficient time to reach desired brightness levels when the display is turned on for periods shorter than the response time of the pixels.

This problem becomes more severe in the case of a line-addressed display, where the display is illuminated sequentially one row at a time. What typically happens is known as a "brightness gradient" effect; rows of the display that are illuminated first (typically the upper rows of the display) receive more time to transition to their desired brightness levels than their subsequent counterparts. Accordingly, the perceived brightness of the display is vertically non-uniform.

A first solution to the above problem attempts to equalize brightness across the display by deliberately darkening certain sections of the display. Brightness equalization techniques, however, negatively affect the contrast ratio of the display defined as the ratio of maximum to minimum brightness of the display.

A second solution to the above problem uses direct addressing to illuminate the display. Direct addressing allows for each pixel of the display to be illuminated independently. Accordingly, it is possible, using direct addressing, to simultaneously illuminate every pixel of the display. While direct addressing seems to solve the "brightness gradient" problem, it is not a viable solution for large displays having thousands of pixels. This is because direct addressing requires separate addressing circuitry and a voltage loading buffer for each pixel of the display.

What is needed therefore are methods and systems that offer scalable solutions for display illumination that do not suffer from the problems described above.

BRIEF SUMMARY OF THE INVENTION

The present invention relates to a method and system for illuminating a display.

In one aspect, the present invention provides a method to illuminate a display having a plurality of pixels. The method works by gradually increasing the brightness of pixels, thereby providing a perceived uniform illumination of the display. The method provides that pixels on a lower portion of a screen are at least partially illuminated before the top portion of the screen is fully illuminated. Accordingly, the "brightness gradient" problem described above is overcome. The method further allows for an initial illumination of a pixel to some initial brightness level, and then for a gradual increase in brightness of the pixel to its desired brightness level by subsequent increments in brightness. This is in contrast to conventional illumination methods, where a pixel must be loaded with its final brightness level before it can be illuminated. The result is a faster apparent illumination response of the display. Conversely, the same method can be used to gradually decrease the brightness of the display.

In one embodiment, a method of increasing the brightness of a pixel on a display to a desired brightness level is provided. The method includes dividing a time required to reach a maximum brightness level into one or more time slices, varying a pixel voltage associated with the pixel according to a sequence of voltage values over the one or more time slices, and gradually increasing the brightness of the pixel according to the pixel voltage. In an embodiment, the desired brightness level is reached at the end of the sequence of voltage values.

In operation, a first pixel is brought to a first brightness level associated with the first time slice. Subsequent pixels are then brought to their first brightness levels. The first pixel is then brought to a second brightness level associated with the second time slice. The process can be iteratively repeated as desired.

In another embodiment, another method of increasing the brightness of a pixel on a display to a desired brightness level is provided. The method includes loading a control field associated with the pixel with a first bit of a bit sequence for a corresponding time slice of a control field time. When the first bit value is zero, the method includes maintaining a previous value of a pixel voltage associated with the pixel for the duration of the time slice. When the first bit value is one, the method includes updating the value of the pixel voltage according to a voltage provided to the pixel. The method, further, includes repeating the above described steps for subsequent bits of the bit sequence and corresponding time slices of the control field time.

Embodiments of the present invention can be employed in line-addressed or field-addressed display systems.

Embodiments of the present invention can be employed in reflective as well as emissive optical systems.

In a further aspect of the present invention, a system for increasing the brightness of a pixel is provided. The system comprises a pixel structure that includes a capacitor having a first and second ports, a control bit element that receives a data signal and a select signal and outputs a control signal, and a logic gate that receives the control signal and an enable signal and outputs a signal to control a switch. The switch couples a voltage to the first port of the capacitor according to the signal output by the logic gate. A voltage of the pixel structure is measured across the first and second ports of the capacitor.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will be described with reference to the accompanying drawings. The drawing in which an element first appears is typically indicated by the leftmost digit(s) in the corresponding reference number.

DETAILED DESCRIPTION OF THE INVENTION

Mixed Pulse Width and Voltage Amplitude Modulation

In one aspect, the present invention provides a method to illuminate a display having a plurality of pixels. The method works by gradually increasing the brightness of pixels, thereby providing a perceived uniform illumination of the display. The method further allows for an initial illumination of a pixel to some initial brightness level, and then for a gradual increase in the brightness of the pixel to its desired brightness level by subsequent increments in brightness. Between adjustments to the pixel brightness, other pixels are adjusted. This is in contrast to conventional illumination methods, where a pixel must be loaded with its final brightness level before it can be illuminated. The result is a faster illumination response of the display. Embodiments of methods according to the present invention will now be provided. For ease of description, these embodiments will be presented with respect to systems with reflective pixels. However, they can be equally applied to systems with emissive pixels such as organic LEDs, for example.

Figure 1:
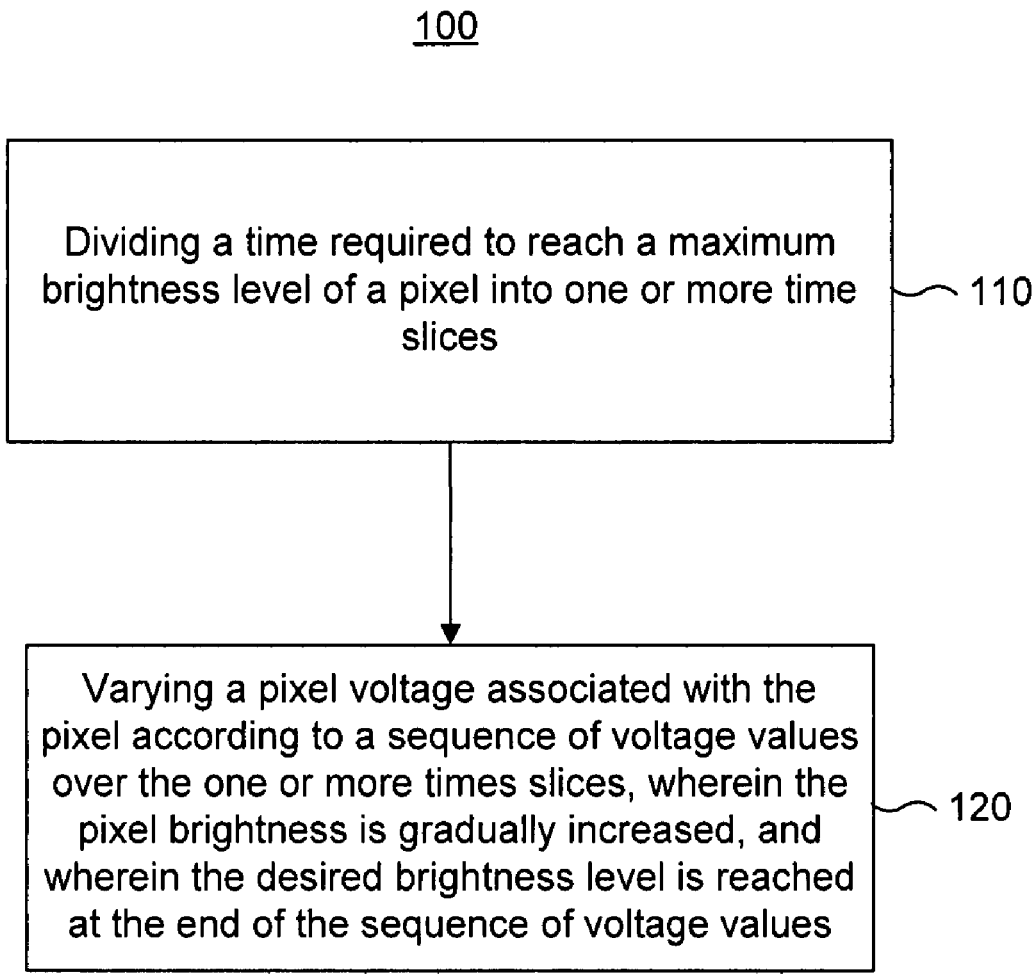
FIG. 1 is a process flowchart for increasing the brightness of a pixel.

FIG. 1 is a process flowchart 100 for increasing the brightness of a pixel according to an embodiment of the present invention. In the embodiment, the pixel is being illuminated to a desired brightness level on a display. Process flowchart 100 begins in step 110, which includes dividing a time required to reach a maximum brightness level of the pixel into one or more time slices. Typically, the time required to reach the maximum brightness level of the pixel is larger than the time required to reach any other brightness level of the pixel. Accordingly, any brightness level of the pixel can be reached within the time required to achieve the maximum brightness level. For ease of illustration, the time required to reach the maximum brightness level of the pixel shall be referred to as control field time in the remainder of this description. In certain embodiments, the control field time is divided into time slices of equal durations. In other embodiments, the time slices may or may not be of equal durations.

Step 120 includes varying a pixel voltage associated with the pixel according to a sequence of voltage values over the one or more time slices. In typical pixel elements, the amount of light reflected (or emitted for emissive technologies such as organic LEDs) by a pixel is directly proportional to a voltage applied to the pixel. This voltage is known as the pixel voltage. The perceived brightness of the pixel is proportional to the integral over time of the amount of light reflected by the pixel. Accordingly, the perceived brightness of the pixel is proportional to the integral over time of the pixel voltage.

In an embodiment of the present invention, the pixel voltage is varied over the one or more time slices of the control field time according to a sequence of voltage values. The sequence of voltage values is selected from a discrete range of voltage values having a maximum "bright" voltage and a minimum "dark" voltage. Typically, the maximum voltage results in the brightest pixel. The minimum voltage, typically zero, results in the darkest pixel.

Since values in the sequence of voltage values may change from one time slice to another of the control field time, the sequence of voltage values determines a time rate of illumination of the pixel over the control field time. Accordingly, the sequence of voltage values not only determines the final brightness level of the pixel, but also determines the rate at which the pixel reaches this brightness level. It is noted that this rate may also be variable over the control field time.

Further, in addition to the number of time slices of the control field time, the range of values from which the sequence of voltage values is selected also determines the brightness resolution of the pixel.

Accordingly, as a result of step 120, the brightness of the pixel is gradually increased according to the pixel voltage, and the desired brightness level of the pixel is reached at the end of the sequence of voltage values. In an embodiment, the pixel brightness is increased starting with the first time slice of the control field time according to the pixel voltage that corresponds to said time slice. The desired brightness may or may not be reached starting with the first time slice. Accordingly, the pixel brightness is gradually increased until the desired brightness level is reached at the end of the sequence of voltage values. This feature according to the present invention therefore allows a pixel to be illuminated immediately. In contrast, in conventional display architectures, a pixel must be loaded with its final voltage before it can be illuminated.

One implementation embodiment of the method introduced in FIG. 1 will now be described with reference to FIG. 2.

Figure 2:
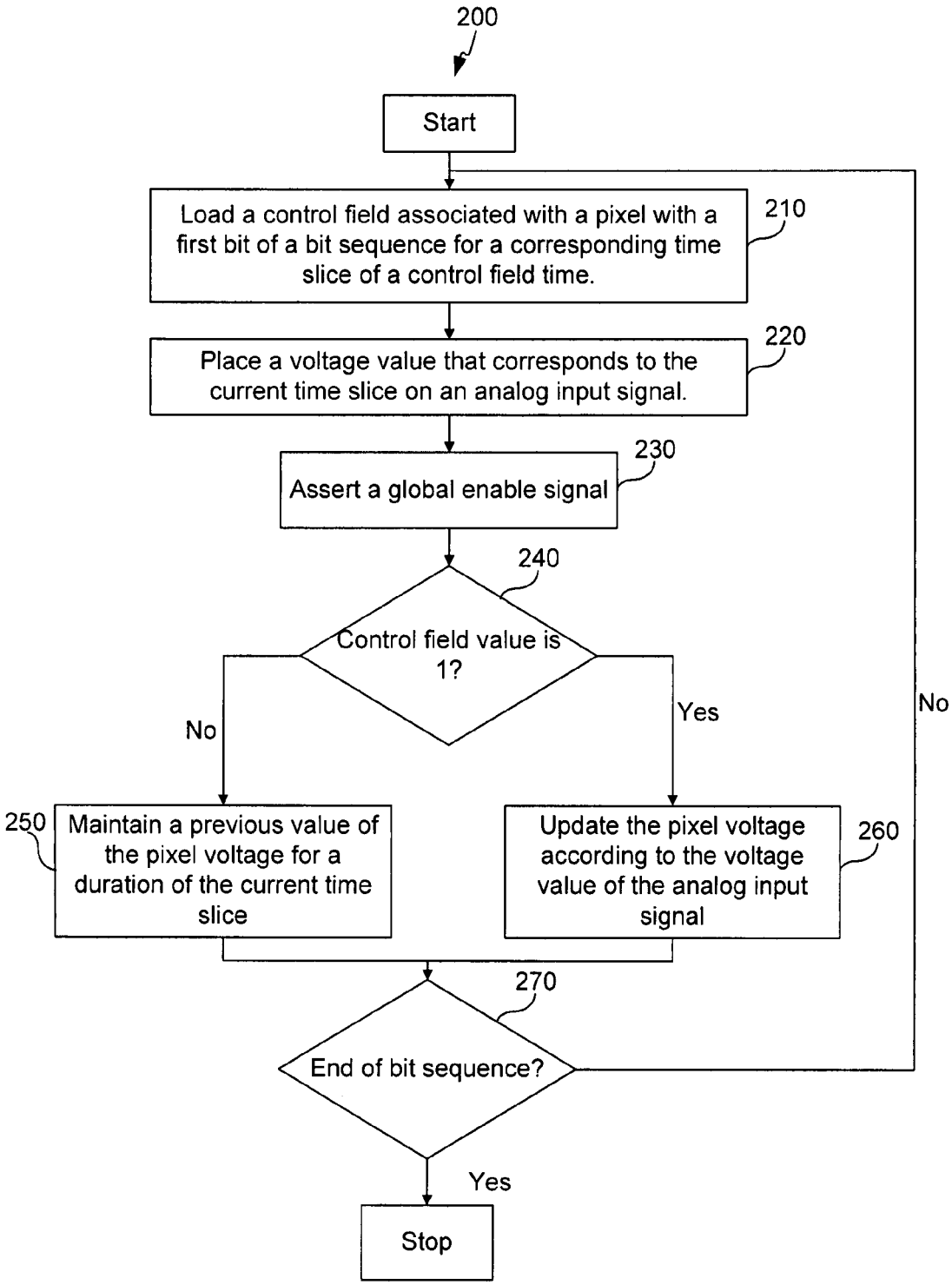
FIG. 2 is another process flowchart for increasing the brightness of a pixel.

FIG. 2 is another process flowchart 200 for increasing the brightness of a pixel according to an embodiment of the present invention. In the embodiment, the pixel is being illuminated to a desired brightness level on a display. Process flowchart 200 begins in step 210, which includes loading a control field associated with the pixel with a first bit of a bit sequence for a corresponding time slice of a control field time. In an embodiment, the control field time is equal to the time required to illuminate the pixel to a maximum brightness level. In another embodiment, the control field time is divided into one or more time slices. The time slices may or may not be of equal durations. In an embodiment, the time slices are selected according to a time slice distribution function, which defines a time duration for each time slice, and wherein a sum of the time slices is equal to the control field time.

In an embodiment, the control field is a one bit field associated with the pixel. Alternatively, the control field is a multi-bit field. The bit sequence represents a sequence of ones and zeros that is loaded into the control field, one bit at a time for each time slice of the control field time. In an embodiment, the bit sequence is a bit vector representation of the brightness level of the pixel.

Note that step 210 may be performed in a variety of methods. In the proposed embodiment, the loading is performed one row at a time, and concurrently for all pixels of a given row of the display. The control bits that are loaded for the row pixels may or may not be the same. Other implementations may load multiple rows at a time, or load columns, or subsection of rows, or may employ any scheme that eventually loads all pixels with the control field.

Step 220 includes placing a voltage value that corresponds to the current time slice on an analog input signal. In an embodiment, the analog input signal is a common analog input signal presented to every pixel of the display.

Subsequently, in step 230, a global enable signal is asserted, which causes the pixel voltage to respond to the analog input signal depending on the value loaded into the control field. The global enable signal allows for the control field of a pixel to be loaded without affecting the pixel voltage. This is done by not asserting the enable signal when loading the control field. Accordingly, the pixel can remain illuminated according to a previous brightness level, while a bit sequence corresponding to a new brightness level is being loaded. When the global enable signal is asserted subsequently, the pixel starts to reflect the new brightness level without its illumination being interrupted. As such, the global enable signal ensures that pixels synchronously respond to voltage values.

Depending on the control field value, the pixel voltage will either respond to the analog input signal or maintain its previous voltage value. As such, step 240 includes examining the control field value. When the control field value is zero, step 250 includes maintaining, for the duration of the time slice, a previous value of the pixel voltage. Conversely, when the control field value is one, step 260 includes updating, according to the analog input signal, the value of the pixel voltage. Accordingly, step 260 includes sampling the analog input signal voltage when the control field value is one and maintaining the sampled value as the pixel voltage. In an embodiment, the analog input signal may change value over the control field time. In another embodiment, the analog input signal is selected according to a voltage sequence, which defines the value of the voltage over each time slice of the control field time. The voltage sequence may be selected from a discrete range of one or more voltage values.

As described above, therefore, the control field associated with the pixel controls the pixel voltage. Accordingly, the bit sequence loaded into the control field determines the pixel voltage, and, subsequently, corresponds to the desired brightness level of the pixel based on the time slice distribution function and the voltage sequence. In an embodiment, the time slice distribution function and the voltage sequence are pre-determined. Based on the time slice distribution function and the voltage sequence, however, in certain embodiments, the desired brightness level of the pixel may be achieved using one or more bit sequences. In other embodiments, the voltage sequence is selected such that, given the time slice distribution function, no two bit sequences may result in the same brightness level. Accordingly, the desired brightness level is achieved using a unique bit sequence loaded into the control field of the pixel.

Further, according to an embodiment of the present invention, the pixel voltage, over every time slice of the control field time, either maintains its previous value or takes a new value.

Process flowchart 200 terminates in step 270, which includes checking whether or not the end of the bit sequence has been reached. If not, the process restarts at step 210, as described above, with a subsequent bit of the bit sequence. Otherwise, the process ends. The desired brightness level of the pixel (and every other pixel of the display) is reached at the end of the process.

Pixel Architecture

Figure 3:
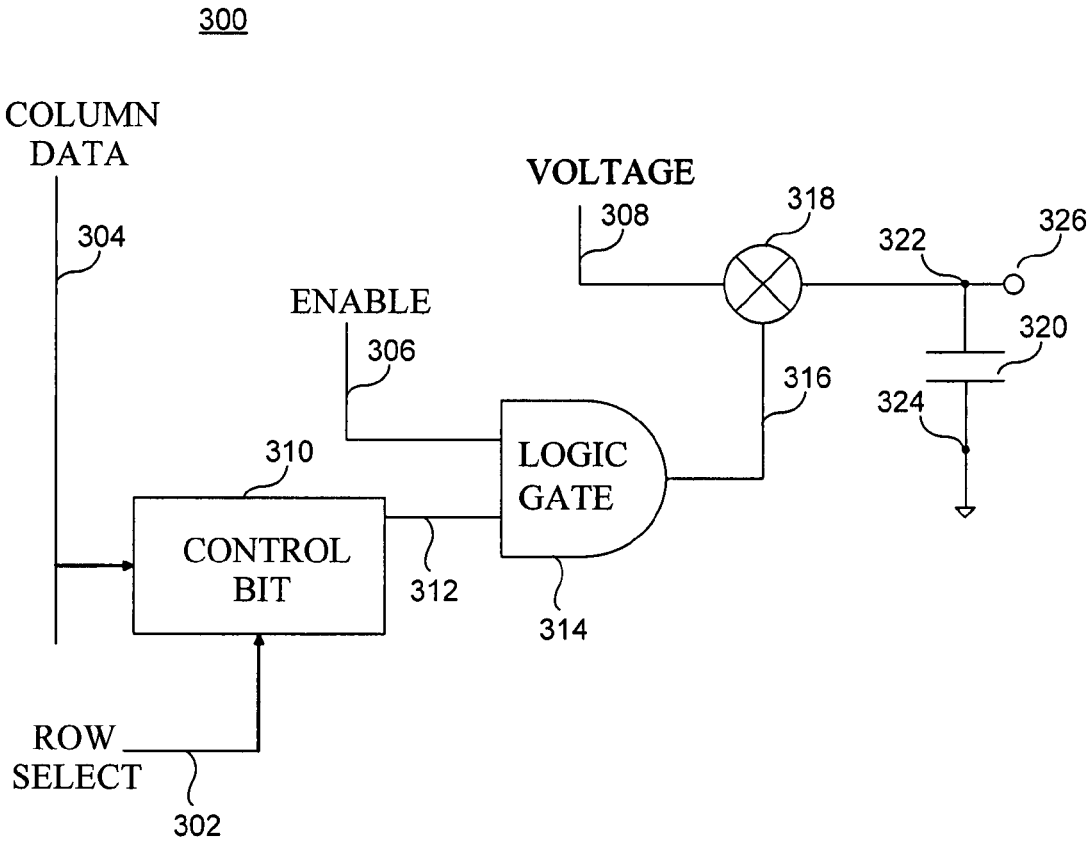
FIG. 3 is an example block diagram of a pixel element.

FIG. 3 is a block diagram of a pixel element 300 according to an embodiment of the present invention. Pixel element 300 implements process flowchart 200 of FIG. 2.

In the embodiment of FIG. 3, pixel element 300 includes a control bit 310, a logic AND gate 314, a switch 318, and a capacitor 320. Capacitor 320 includes a first 322 and a second 324 port. A pixel voltage signal 326 of pixel element 300 is measured across the first 322 and second 324 ports of capacitor 320. As would be understood by a person skilled in the art, other logic circuitry implementations may be used equivalently to logic AND gate 314.

Still referring to FIG. 3, control bit 310 receives a column data signal 304 and a row select signal 302. Column data signal 304 includes a bit sequence for control bit 310. Row select signal 302 asserts whether or not control bit 310 reads column data signal 304. Control bit 310 outputs a control signal 312 to a first input port of logic AND gate 314. Concurrently, an enable signal 306 is input into a second input port of logic AND gate 314. Logic AND gate 314 outputs, based on signals 312 and 306, output signal 316 to switch 318. Signal 316 controls switch 318 to couple a voltage 308 to capacitor 320 when signal 316 is a logic one, and to decouple voltage 308 from capacitor 320 when signal 316 is a logic zero.

The operation of pixel element 300 to increase the brightness of an associated pixel on a display to a desired brightness level will now be described, with reference to FIG. 3, according to an embodiment of the present invention. In the embodiment, the display is a sequentially line-addressed display, for example.

Referring to FIG. 3, row select signal 302 is asserted to select a row of pixels on the display that includes the pixel associated with pixel element 300. Row select signal 302, accordingly, allows control bit 310 to read column data signal 304. In an embodiment, column data signal 304 is presented simultaneously for all pixel elements of the particular row selected by row select signal 302. In another embodiment, row select signal 302 is asserted for a particular row of the display according to a time slice distribution function as described above with reference to FIG. 2.

Still referring to FIG. 3, control bit 310 reads and stores the bit value presented on column data signal 304. In an embodiment, the bit value corresponds to a first bit of a bit sequence, which corresponds to the desired brightness level of pixel element 300.

When all pixel elements of the display have had their associated control bits loaded, enable signal 306 is asserted. Note that signal 312 follows column data signal 304 presented to control bit 310. Accordingly, when enable signal 306 is asserted, output signal 316 of logic AND gate 314 follows signal 312. In other words, signal 316 is zero when signal 312 is zero, and is one when signal 312 is one. The output 316 of logic AND gate 314, accordingly, directly reflects the value loaded into control bit 310.

Still referring to FIG. 3, switch 318 receives signal 316 and couples voltage 308 to capacitor 320 when signal 316 is a logic one. Accordingly, when control bit 310 has a bit with a value of one loaded thereinto, capacitor 320 is coupled to voltage 308, and pixel voltage 326 is set according to voltage 308. On the other hand, when control bit 310 has a bit with a value of zero loaded thereinto, capacitor 320 is decoupled from voltage 308, and pixel voltage 326 maintains its previous value.

The process described above repeats for subsequent bits loaded into control bit 310, until the end of the bit sequence corresponding to the desired brightness level is reached. Pixel voltage 326 varies according to the loaded bit sequence and voltage 308, thereby generating the desired brightness level.

In another embodiment, pixel element 300 includes a plurality of control bits, the values of which determine the coupling of capacitor 320 (or its decoupling) to one of a plurality of voltage signals in any particular time slice.

Example Pixel Voltage Generation

As described above, in an embodiment of the present invention, the bit sequence loaded into the control field associated with the pixel determines the pixel voltage based on the time slice distribution function and the voltage sequence. Subsequently, the bit sequence determines the brightness level of the pixel. An example of generating pixel voltages according to this embodiment of the present invention is now provided.

Figure 4:
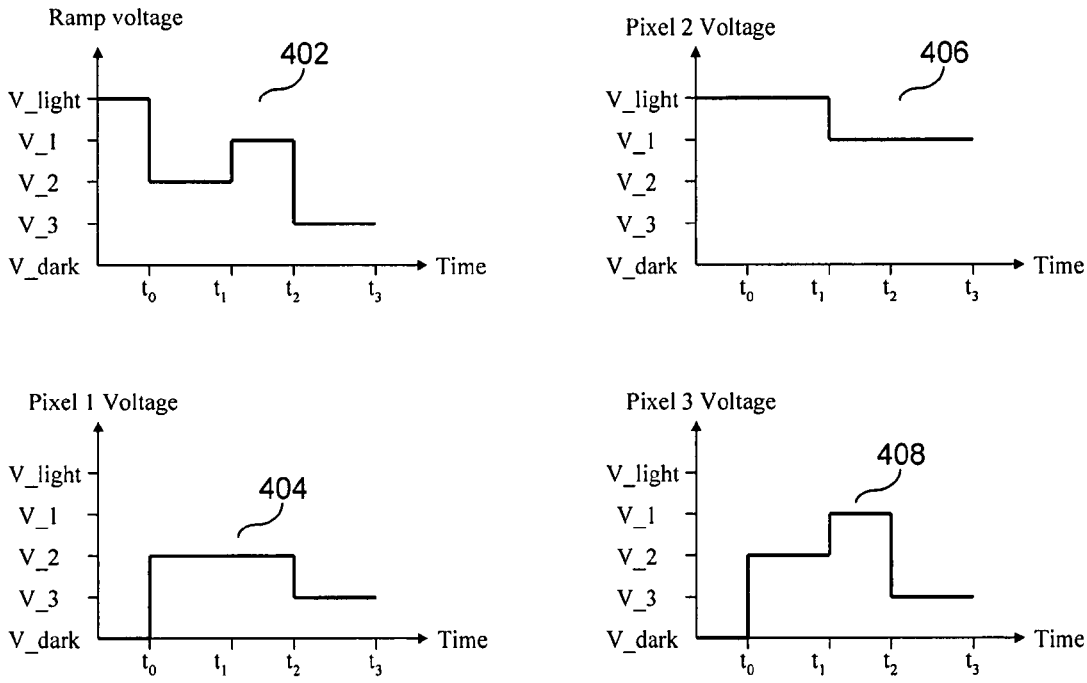
FIG. 4 is an example timing diagram for pixel voltage generation.

FIG. 4 is an example illustration of generating pixel voltages according to an embodiment of the present invention. In the example of FIG. 4, voltage 402 represents a voltage sequence in time. The voltage sequence takes values from a discrete range of voltage values {V_dark, V__3, V__2, V__1, V_light}. Further, the voltage sequence varies according to a time slice distribution function represented by times $t_0$, $t_1$, $t_2$, and $t_3$ in FIG. 4. Time $t_0$, $t_1$, $t_2$, and $t_3$ define a time slice distribution given by time slices $t_0$, $(t_1-t_0)$, $(t_2-t_1)$, and $(t_3-t_2)$. Time slices $t_0$, $(t_1-t_0)$, $(t_2-t_1)$, and $(t_3-t_2)$ may or may not be of equal durations. In an embodiment, $t_3$ is equal to the control field time, as described above with reference to FIG. 2.

Pixel 1 voltage 404, pixel 2 voltage 406, and pixel 3 voltage 408 represent exemplary pixel voltages generated using voltage 402 over time $t_3$. Pixel 1 voltage 404 is associated with a first pixel 1. Similarly, pixel 2 voltage 406 and pixel 3 voltage 408 are associated with a second and third pixels 2 and 3, respectively. Pixels 1, 2, and 3 may be pixels of the same display, for example.

Initially, all pixel voltages are set to V_dark, which corresponds to the darkest pixel.

Pixel 1 voltage 404 is generated by loading a bit sequence {0, 1, 0, 1} into the control field associated with pixel 1. Note that, accordingly, pixel voltage 1 maintains its initial voltage value (V_dark) for the first time slice, samples voltage 402 for the second time slice, holds its previous voltage value (V__2) over the third time slice, and finally samples voltage 402 over the fourth time slice.

Similarly, pixel voltage 406 is generated by loading a bit sequence {1, 0, 1, 0} into the control field associated with pixel 2. Pixel voltage 408 is generated by loading a bit sequence {0, 1, 1, 1} into the control field associated with pixel 3.

The integral over time of pixel voltages 404, 406, and 408 each corresponds to a different value. For example, the integral over time of pixel voltage 404 is equal to $[t_0 \cdot V_dark + (t_2-t_0) \cdot V_2 + (t_3-t_2) \cdot V_3]$. Similarly, the integral over time of pixel voltage 406 is equal to $[t_1 \cdot V_light + (t_3-t_1) \cdot V_1]$. The integral over time of pixel 408 is equal to $[t_0 \cdot V_dark + (t_1-t_0) \cdot V_2 + (t_2-t_1) \cdot V_1 + (t_3-t_2) \cdot V_3]$.

Accordingly, pixel voltages 404, 406, and 408 each corresponds to a different brightness level for corresponding pixels 1, 2, and 3, respectively. In an embodiment voltage 402 is selected such that no two bit sequences result in equal brightness levels. Accordingly, every brightness level is achieved using a unique bit sequence.

Example Bit Sequence to Brightness Level Mapping

As described above with reference to FIG. 2, according to an embodiment of the present invention, the pixel voltage, over each time slice of the control field time, either maintains its previous value or takes a new value. Accordingly, the pixel voltage takes up to two voltage values over each time slice of the control field time. An example bit sequence to brightness level mapping is now provided.

Figure 5:
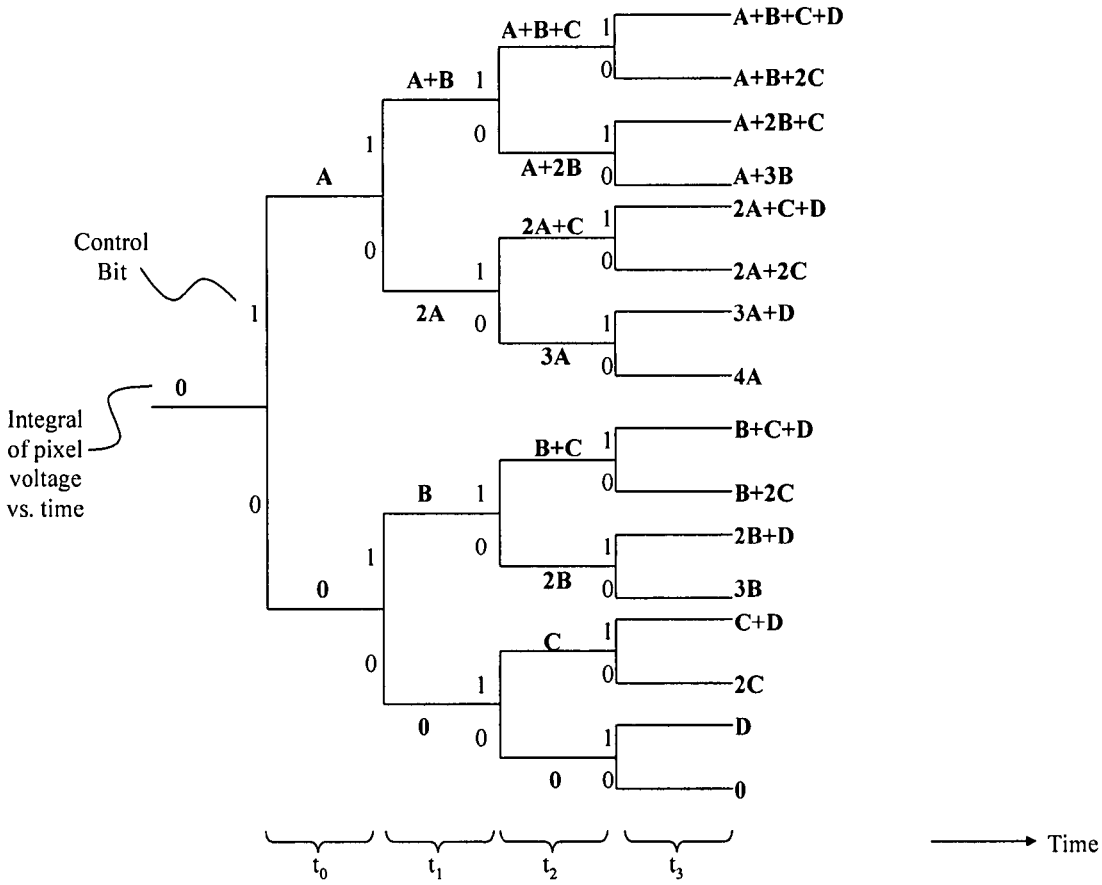
FIG. 5 is an example bit sequence to brightness level mapping.

FIG. 5 illustrates an example bit sequence to brightness level mapping according to an embodiment of the present invention. In the example of FIG. 5, brightness levels are represented in terms of corresponding integrals of pixel voltage over time.

Referring to FIG. 5, the control field time is divided into four time slices $t_0$, $t_1$, $t_2$, and $t_3$ having equal durations. A four bit sequence is used over the control field time. The voltage sequence, in the example of FIG. 5, is such that an integral of the voltage over time slices $t_0$, $t_1$, $t_2$, and $t_3$ is equal to A, B, C, and D, respectively.

Accordingly, 16 brightness levels can be achieved. For example, a darkest brightness level is achieved using a bit sequence {0,0,0,0}. Similarly, a lightest brightness level is achieved using a bit sequence {1,1,1,1}. A brightness level, corresponding to a pixel voltage integral over time of 4 A, is achieved using a bit sequence {1,0,0,0}, wherein the voltage is sampled over the first time slice to and then maintained for the following time slices $t_1$, $t_2$, and $t_3$.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method of illuminating a pixel on a display to a desired brightness level, comprising:

(a) loading a control field associated with the pixel with a first bit of a bit sequence for a corresponding time slice of a control field time;

(b) maintaining, when a value of the first bit is zero, a previous value of a pixel voltage associated with the pixel for a duration of the corresponding time slice;

(c) updating, when the value of the first bit is one, a value of the pixel voltage according to an input voltage and maintaining the updated value of the pixel voltage for the duration of the time slice; and (d) repeating steps (a)-(c) for subsequent bits of the bit sequence and corresponding time slices of the control field time, wherein an integral over time of the pixel voltage corresponds to the desired brightness level of the pixel.

2. The method of claim 1, wherein time slices are selected according to a time slice distribution function, said time slice distribution function defining a time duration for each time slice, and wherein a sum of the time slices is equal to the control field time.

3. The method of claim 2, wherein the time slices of the control field time are of substantially equal durations.

4. The method of claim 2, wherein the time slices of the control field time are of different durations.

5. The method of claim 2, wherein step (c) further comprises:

(e) updating, when both the value of the first bit is one and a value of an enable signal is one, the value of the pixel according to an input voltage and maintaining the updated value of the pixel voltage for the duration of the time slice.

6. The method of claim 2, wherein a value of the input voltage is selected according to a voltage sequence, the voltage sequence defining the value of the input voltage over each time slice of the control field time.

7. The method of claim 6, wherein the voltage sequence comprises one or more voltage values.

8. The method of claim 6, wherein the control field is loaded with the bit sequence over the control field time, and wherein the bit sequence corresponds to the desired brightness level of the pixel based on the time slice distribution function and the voltage sequence.

9. The method of claim 8, wherein the desired brightness level of the pixel is achieved using a unique bit sequence.

10. The method of claim 8, wherein the desired brightness level of the pixel is achieved using one or more bit sequences.

11. The method of claim 8, wherein the pixel is illuminated starting with the first bit of the bit sequence before reaching the desired brightness level of the pixel at an end of the hit sequence.

* * * * *